United States Patent [19]

Haynes

[11] 4,443,305

[45] Apr. 17, 1984

[54] EMULSION ELECTROWINNING

[75] Inventor: Richard Haynes, East Windsor Township, Mercer County, N.J.

[73] Assignee: Western Electric Company, Inc., New York, N.Y.

[21] Appl. No.: 490,602

[22] Filed: May 2, 1983

[51] Int. Cl.[3] ..... C25C 1/00

[52] U.S. Cl. ..... 204/59 M; 204/105 R; 204/109; 204/111; 204/130

[58] Field of Search ..... 204/109, 111, 105 R, 204/59 M, 130

[56] References Cited

U.S. PATENT DOCUMENTS

| | | | |
|---|---|---|---|
| 1,514,737 | 11/1924 | Smith | 204/98 |
| 1,794,585 | 3/1931 | Cain | 204/105 R |
| 1,799,157 | 4/1931 | Drouilly | 204/105 R |
| 2,820,748 | 1/1958 | Von Bichowshy | 204/59 |
| 3,206,385 | 9/1965 | Meinlejohn et al. | 204/140 |
| 3,278,400 | 10/1960 | Strolmeier | 204/3 |
| 3,493,433 | 2/1970 | Hoffmann | 136/28 |
| 3,707,407 | 12/1972 | Chilton et al. | 204/250 |
| 3,880,743 | 4/1975 | Lang | 204/165 |
| 3,966,569 | 6/1976 | Reinhardt et al. | 204/108 |
| 4,078,978 | 3/1978 | Zirngiebl | 204/98 |
| 4,164,456 | 8/1979 | Korenowski | 204/52 |

FOREIGN PATENT DOCUMENTS

| | | | |
|---|---|---|---|
| 274495 | 5/1930 | Italy | 204/105 R |
| 349490 | 9/1972 | U.S.S.R. | 204/105 R |

OTHER PUBLICATIONS

"Refining of Amfrom Precious Metal by Liquid Liquid Extraction", by B. F. Rimmer, Chem. & Industry, 1-1-9-74.

*Primary Examiner*—R. L. Andrews
*Attorney, Agent, or Firm*—J. F. Spivak

[57] ABSTRACT

A process of electrodepositing a metal from an organic phase containing a salt or complex of that metal includes the steps of creating a dispersion of the organic phase in a conducting aqueous electrolyte with which it is immiscible and electrodepositing the metal onto a cathode which is immersed in the organic phase or the dispersion.

14 Claims, 3 Drawing Figures

EMULSION ELECTROWINNING

TECHNICAL FIELD

This invention relates to electrowinning of a metal from an organic media and more particularly electrowinning from an organic media in contact with an immiscible aqueous media in the presence of an emulsion of the two liquids.

BACKGROUND OF THE INVENTION

It is often desirable to recover metals from non-aqueous, organic solutions. In the past, this has been done by various means such as stripping the compound of the metal from the organic phase into an aqueous phase and then chemically or electrolytically depositing the metal, crystallizing the metal compound from the organic phase followed by further processing the crystals so as to deposit the metal or electrowinning, i.e., electrodepositing the metal directly from the organic phase onto a cathode placed therein.

The recovery of metals as indicated above is particularly important when metals are refined or recovered from wastes utilizing solvent extraction techniques for separating the various metals in solution. This technique is based upon the varying degree of solubility of certain metal compounds or complexes between immiscible aqueous and organic solvents under certain conditions of pH and other factors.

In the past, electrodeposition of the metal from the organic phase was generally not commercially feasible due to the fact that the organic solvent which was employed to effectuate separation was generally a poor electrolyte and hence limited the current and thus the rate of metal deposition at voltages which did not result in solvent breakdown.

I have now discovered a technique for electrodepositing metals from organic solvents which can be used efficiently and with substantially higher deposition rates than otherwise expected.

SUMMARY OF THE INVENTION

A process of electrodepositing a metal from an organic phase containing a salt or complex of that metal includes the steps of creating a dispersion of the organic phase and a conducting aqueous electrolyte with which it is immiscible and electrodepositing the metal onto a cathode which is immersed in the organic phase or the dispersion.

DETAILED DESCRIPTION OF THE INVENTION

Since applicant has been most interested in the purification of gold by solvent extraction the novel technique will be described primarily in terms of gold recovery from organic solvent systems. However, it should be understood that the principle of the method taught herein is general in nature and not limited to either gold recovery or to the specific solvent systems described herein. One may refer to the book entitled, *Solvent Extraction* by G. H. Morrison and H. Frieser for an overview of the many solvent extraction systems available.

With respect to gold and certain other metals, for example, palladium and tin, these metals may be extracted into an organic phase as described below as their chloride salts from a 2 N aqueous HCl solution. An emulsion or dispersion of the organic media in the aqueous media or vice versa may be formed and maintained by continued agitation (e.g., mechanical or ultrasonic) or the addition of an emulsion promoting agent or both, and the metal electrodeposited utilizing a cell configured as shown in any of FIG. 1, 2 or 3, for example. Examples of such systems are:

| Organic Phase | Metal Extracted and Then Deposited |
|---|---|
| *Dibutyl Carbitol | Au |
| Tributyl Phosphate | Au, Pd |
| Toluene, 5% Trioctylphorine Oxide | Au |
| Hexone, Tetrabutylammonium Iodide | Au, Pd, Sn |
| Nitrobenzene | Au |
| Kerosene, Trioctylamine | Au |

*A trademark of Union Carbide for bis(2-butyloxyethyl) ether.

Examples of emulsifiers which may be employed to obtain an emulsion are SPAN 80, a sorbitan monooleate and TWEEN 60, a polyoxyethylene sorbitan monostearate. Emulsifiers generally are well know and are commercially available.

EXPERIMENTAL

In the following examples, unless otherwise indicated, the metals are in the form of the metal chloride and are extracted into an organic phase from an aqueous 2 N HCl solution containing the metal chlorides. Emulsions of the organic phase dispersed in or with the aqueous phase were formed by constant mechanical stirring of the organic/aqueous mixture. The ratio of the volumes of organic phase to aqueous phase varied from 1 to 5 depending upon the system.

Figure 1:
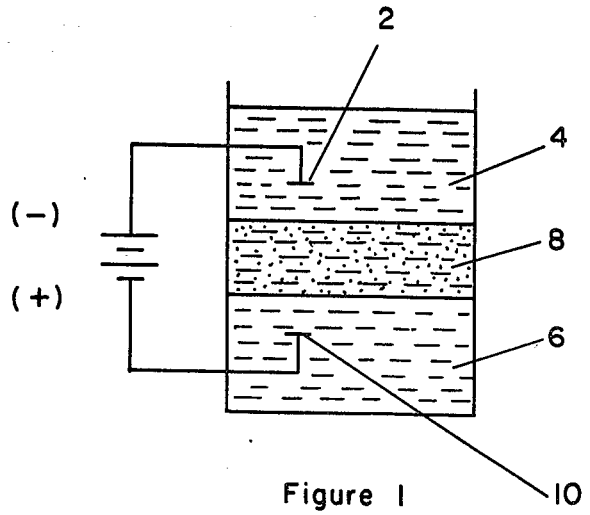
FIGS. 1–3 are schematic diagrams showing various electrode placements with respect to the dispersed phase (i.e., the emulsion).

Both platinum and copper were used as cathodes in these experiments with an inert anode such as a platinum anode. FIG. 1 shows the cathode 2 in the organic phase 4 which is separated from the aqueous phase 6 by the dispersed phase or emulsion 8. The anode 10 is shown as being immersed in the aqueous phase 6. The conducting media is not the same as that from which the extraction is performed. This cell design is particularly suitable when the organic phase is highly conducting and the distribution coefficient, i.e., the ratio of the concentration of metal in the organic phase to the concentration of the metal in the aqueous phase, is low.

Figure 2:
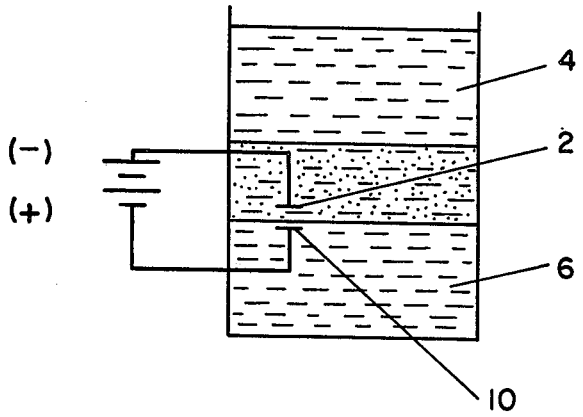
Figure 3:
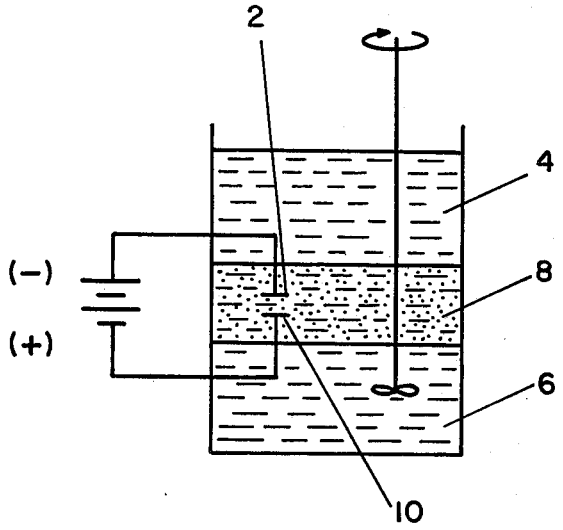

FIGS. 2 and 3 which show the cathode 2 immersed in the dispersed phase 8 and the anode 10 in the aqueous phase 6 and dispersed phase 8, respectively, are most efficient when (1) the organic phase has a low conductivity, (2) there is a voltage breakdown of the solvent before electrodeposition or (3) there is a maximum voltage (power) based upon economic or other considerations. It should be noted that three distinct layers need not be present. For example, if agitation is constant and sufficient, the entire organic phase may be dispersed within the aqueous phase. Such configurations are obviously also included as part of the novel method taught herein.

In attempting to recover gold from tankhouse slime resulting from a copper electrorefining process, the gold is extracted from the processed slime into Dibutyl Carbitol ®. The process used up until this point for the separation and extraction of the gold is more fully described in an article by B. F. Rimmer, *Chemistry and Industry*, Jan. 19, 1974, p. 63, which article is incorporated herein by reference. However, instead of precipitating the gold by oxalic acid reduction, as set forth by Rimmer, emulsion electrowinning employing an apparatus similar to that shown in FIG. 2 is used to recover the gold. However, the organic phase was dispersed throughout the continuous aqueous phase. The initial concentration of gold in the solution was 47.3 gl liter. Recovery of the gold approached 100% with gold purity greater than 99.5%. Repetitive electrowinning, i.e., electrowinning of the gold for a time followed by interruption of the process and collection of the gold gave the following results:

| Sequence No. | Concentration Au Remaining in Solution After Sequence (% Au) | Voltage (Volts) | Current Density (Amps/ft.$^2$) | Efficiency (%) |
|---|---|---|---|---|
| 1 | 90.5 | 7 | 36 | 73.5 |
| 2 | 79.7 | 5 | 18 | 83.3 |
| 3 | 76.5 | 4 | 7.2 | 61.2 |
| 4 | 71.2 | 10 | 72 | 40.8 |
| 5 | 57.8 | 13 | 126 | 59.3 |
| 6 | 55.9 | 15–19 | 180 | 5.9 |
| 7 | 0.6 | 11–13 | 126 | 26.9 |
| 8 | 0.0 | 13 | 126 | 0.6 |

It may be noted that variations in stirring rate which in turn varies the degree of formation of the dispersed phase will affect the results.

In order to insure that electrolysis was dependent upon the existence of the dispersed phase or emulsion, electrolysis was attempted in a Dibutyl Carbitol system with (a) both electrodes in the aqueous phase, (b) both electrodes in the organic phase as well as (c) where at least the cathode is placed in the dispersed phase. These experiments were performed under a voltage as high as 40 volts D.C. in the organic phase. It was found that no deposition was observed from the aqueous phase due to the fact that the metal ions had been substantially extracted from that phase into the organic phase. Similarly, even though the organic phase contained a high metal concentration, no electrolysis was observed when both electrodes were in that phase due to the high resistivity of the organic phase. In comparison, however, gold readily electrolytically deposited on the cathode in the dispersed phase at voltages of only 4–15 volts. Typically, experiments employed platinum electrodes having an area of about 6 sq. inches and a cathode-anode distance of 2 inches.

Potential advantages of the novel technique are its application to either higher rate continuous or batch processing, ability to produce easily collectable powdered metal deposits, minimizes power requirements, eliminates solvent degradation and reduces solvent losses.

The novel process recited herein need not be used only to electrodeposit a metal from an organic phase. Electrodeposition involves the reduction of a metal cation to the metallic or zero valence state. However, there are instances where reduction to an intermediate (i.e., lower) ionic state may be desired without complete reduction to the metal. For example, certain metals which exhibit multiple valence states may have a higher valence state which is much more soluble in an organic media than its lower valence state. Reduction to the lower state would then allow stripping of the metal ion from an organic phase into an aqueous phase in which the lower valence cation is more soluble. Ferric ions, for example, form a chloride complex which is readily soluble in many organics, e.g., either, acetylacetone, etc. Reduction of this ion to the ferrous ion can cause the ion to be stripped from the organic into an aqueous phase in contact therewith.

It is to be understood that the abovedescribed embodiments are simply illustrative of the principles of the invention. Various other modifications and changes may be devised by those skilled in the art which will embody the principles of the invention and fall within the spirit and scope thereof.

What is claimed is:

1. A process for electrowinning a metal from an organic phase including the steps of creating a dispersed phase comprising a dispersion of the organic phase with an immiscible conducting aqueous phase and electrowinning the metal from the dispersed phase.

2. The process recited in claim 1, wherein a cathode is in contact with the dispersed phase.

3. The process recited in claim 2, wherein an anode, which is spaced from said cathode, is also in contact with the dispersed phase.

4. The process recited in claim 2, wherein an anode, spaced from said cathode, is in contact with the aqueous phase.

5. The process recited in claim 1, wherein a cathode is in contact with the organic phase and the anode which is spaced therefrom is in contact with the aqueous phase, the dispersed phase being intermediate the other two phases.

6. The method recited in claim 1, wherein the dispersion is created by agitation.

7. The method recited in claim 1, wherein the dispersion is created by the addition of an emulsifying agent.

8. A method for electrowinning gold from a solvent extraction system comprises extracting the gold from an aqueous phase into an organic phase, creating a dispersed phase comprising the organic phase dispersed with the aqueous phase and electrowinning the gold from the dispersed phase.

9. The method recited in claim 8, wherein the dispersion is created by constant stirring of the phases.

10. The method recited in claim 8, wherein the electrodes used are inert.

11. The process recited in claim 10, wherein the cathode is in contact with the dispersed phase.

12. A method of removing a metal ion from an organic phase comprises the steps of causing a dispersion of the organic phase with an aqueous phase and electrolytically reducing the ion to a species which is relatively insoluble in the organic phase.

13. The method recited in claim 12, wherein the metal exhibits more than one ionic valence state and wherein the higher valence state is soluble in the organic phase while a lower valence state to which it may be reduced is relatively more soluble in the aqueous phase.

14. The method recited in claim 12, wherein the metal ion is reduced to the metallic state.

* * * * *